US005564290A

United States Patent [19]

Bonaquist et al.

[11] Patent Number: 5,564,290

[45] Date of Patent: Oct. 15, 1996

[54] CRYOGENIC RECTIFICATION SYSTEM WITH DUAL PHASE TURBOEXPANSION

[75] Inventors: Dante P. Bonaquist; John H. Ziemer; Cheryl A. Engels, all of Grand Island; James B. Wulf, Williamsville; Robert A. Beddome, Tonawanda, all of N.Y.

[73] Assignee: Praxair Technology, Inc., Danbury, Conn.

[21] Appl. No.: 536,588

[22] Filed: Sep. 29, 1995

[51] Int. Cl.[6] ..... F25J 3/02

[52] U.S. Cl. ..... 62/646; 62/654; 62/939

[58] Field of Search ..... 62/24, 25, 38, 62/41, 646, 654, 939

[56] References Cited

U.S. PATENT DOCUMENTS

| | | | |
|---|---|---|---|
| 4,303,428 | 12/1981 | Vandenbussche | 62/41 |
| 4,345,925 | 8/1982 | Cheung | 62/13 |
| 4,372,764 | 2/1983 | Theobald | 62/41 |
| 4,806,136 | 2/1989 | Kiersz et al. | 62/18 |
| 5,108,476 | 4/1992 | Dray et al. | 62/24 |
| 5,114,452 | 5/1992 | Dray | 62/24 |
| 5,237,822 | 8/1993 | Rathbone | 62/25 |
| 5,329,776 | 7/1994 | Grenier | 62/24 |
| 5,337,570 | 8/1994 | Prosser | 62/25 |
| 5,365,741 | 11/1994 | Roberts et al. | 62/38 |
| 5,398,514 | 3/1995 | Roberts et al. | 62/38 |

*Primary Examiner*—Ronald C. Capossela
*Attorney, Agent, or Firm*—Stanley Ktorides

[57] ABSTRACT

A cryogenic rectification system for producing elevated pressure gaseous oxygen wherein pressurized liquid oxygen is vaporized against pressurized working fluid which is then turboexpanded to form a dual phase stream having both vapor and liquid fractions.

6 Claims, 3 Drawing Sheets

CRYOGENIC RECTIFICATION SYSTEM WITH DUAL PHASE TURBOEXPANSION

TECHNICAL FIELD

This invention relates generally to cryogenic air separation and more particularly to cryogenic air separation wherein pressurized liquid oxygen is vaporized to produce elevated pressure gaseous oxygen.

BACKGROUND ART

Oxygen is produced commercially in large quantities by the cryogenic rectification of feed air, generally employing the well known double column system, wherein product oxygen is taken from the lower pressure column. At times it may be desirable to produce oxygen at a pressure which exceeds its pressure when taken from the lower pressure column. In such instances, gaseous oxygen may be compressed to the desired pressure. However, it is generally preferable for capital cost purposes to remove oxygen as liquid from the lower pressure column, pump it to a higher pressure, and then vaporize the pressurized liquid oxygen to produce the desired elevated pressure product oxygen gas.

The pressurized liquid oxygen is vaporized against a pressurized working fluid which is then introduced into the cryogenic rectification plant. The working fluid is throttled from the pressure required for the heat exchange to the pressure required by the plant. This results in an energy loss due to the thermodynamic irreversibility of the throttling step. It would be desirable to recover at least some of the lost work associated with the throttling of the pressurized working fluid to the pressure needed by the cryogenic rectification plant.

Accordingly, it is an object of this invention to provide a cryogenic rectification system which can produce elevated pressure gaseous oxygen by the vaporization of pressurized liquid oxygen against a pressurized working fluid while recovering at least some of the work lost when the pressurized working fluid is expanded to a pressure suitable for the cryogenic rectification plant.

SUMMARY OF THE INVENTION

The above and other objects, which will become apparent to one skilled in the art upon a reading of this disclosure, are attained by the present invention which is:

A method for producing elevated pressure gaseous oxygen comprising:

(A) introducing feed air into a cryogenic rectification plant and separating the feed air within the cryogenic rectification plant to produce liquid oxygen;

(B) withdrawing liquid oxygen from the cryogenic rectification plant and increasing the pressure of the withdrawn liquid oxygen to produce elevated pressure liquid oxygen;

(C) compressing a working fluid to produce pressurized working fluid and passing the pressurized working fluid in indirect heat exchange with elevated pressure liquid oxygen thereby vaporizing the elevated pressure liquid oxygen to produce elevated pressure gaseous oxygen and cooled pressurized working fluid;

(D) turboexpanding the cooled pressurized working fluid to produce a dual phase working fluid having both a liquid phase and a gaseous phase; and (E) passing the dual phase working fluid into the cryogenic rectification plant.

As used herein, the terms "turboexpansion" and "turboexpander" mean respectively method and apparatus for the flow of high pressure fluid through a turbine to reduce the pressure and the temperature of the fluid thereby generating refrigeration.

As used herein, the term "column" means a distillation or fractionation column or zone, i.e., a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineers' Handbook fifth edition, edited by R. H. Perry and C. H. Chilton, McGraw-Hill Book Company, New York, Section 13, *The Continuous Distillation Process.* The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at temperatures at or below 150 degrees Kelvin (K).

As used herein, the term "indirect heat exchange" means the bringing of two fluid streams into heat exchange relation without any physical contact or intermixing of the fluids with each other.

As used herein the term "cryogenic rectification plant" means the columns wherein feed air is separated by cryogenic rectification, as well as interconnecting piping, valves, heat exchangers and the like.

As used herein the terms "upper portion" and "lower portion" of a column mean those portions respectively above and below the midpoint of the column.

As used herein the terms "liquid oxygen" and "gaseous oxygen" means respectively a liquid and a gas having an oxygen concentration equal to or greater than 50 mole percent.

As used herein the terms "liquid nitrogen" and "gaseous nitrogen" mean respectively a liquid and a gas having a nitrogen concentration equal to or greater than 80 mole percent.

As used herein, the term "feed air" means a mixture comprising primarily nitrogen and oxygen such as ambient air.

As used herein, the term "vaporized" means passing from the liquid to the vapor state if the fluid is below its critical pressure, and undergoing transition warming if the fluid is at or above its critical pressure.

DETAILED DESCRIPTION

The invention comprises the two-phase turboexpansion of pressurized working fluid after it is employed to vaporize pumped liquid oxygen in a product boiler and before it is passed into the columns of the cryogenic rectification plant. It is possible to expand a subcooled high pressure working fluid without causing any phase change. However, the production of refrigeration and work by the turboexpander is greatly increased when a phase change occurs within the turboexpander.

Figure 1:
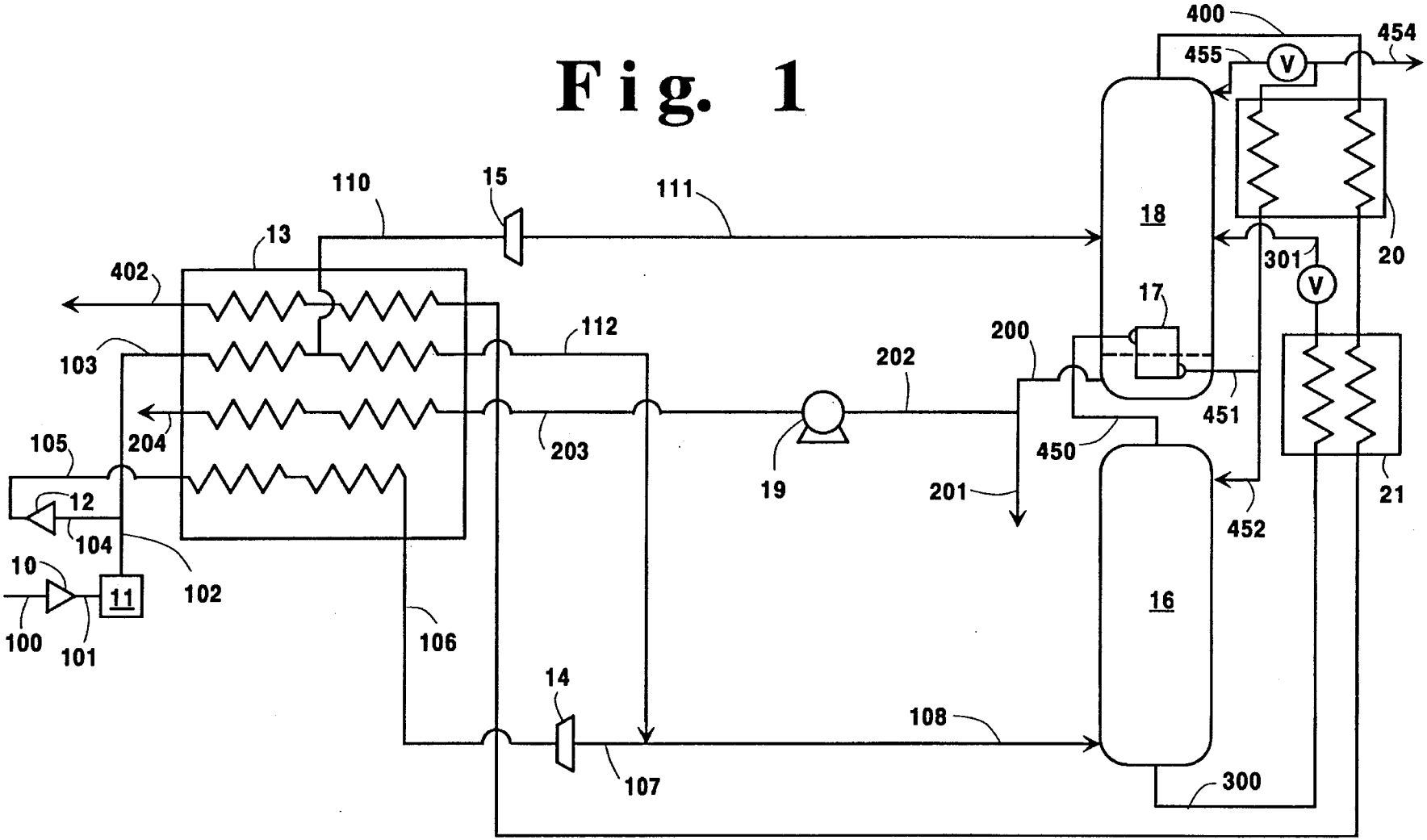
FIG. 1 is a schematic representation of one preferred embodiment of the invention.

The invention will be described in detail with reference to the Drawings. Referring now to FIG. 1, feed air 100 is compressed in compressor 10 to a pressure within the range of from 65 to 85 pounds per square inch absolute (psia) and resulting feed air 101 is cleaned of high boiling impurities, such as carbon dioxide, water vapor and hydrocarbons in purifier 11. Cleaned, compressed feed air 102 is divided into a first portion 103, comprising from 60 to 80 percent of feed air 100, and into second portion 104 comprising from 20 to 40 percent of feed air 100. Stream 103 is cooled by passage through main heat exchanger 13 against return streams and resulting cooled stream 112 is passed into the cryogenic rectification plant. In the embodiment illustrated in FIG. 1 the cryogenic rectification plant comprises a double column having higher pressure column 16, operating at a pressure within the range of from 60 to 80 psia, and lower pressure column 18, operating at a pressure less than that of higher pressure column 16 and within the range of from 15 to 25 psia. In the embodiment illustrated in FIG. 1 stream 112 is combined with the discharge from two phase turboexpander 14 and the combined stream 108 is passed into higher pressure column 16. If desired, a portion 110 of stream 103 may be withdrawn prior to complete traverse of main heat exchanger 13, turboexpanded through turboexpander 15 to produce turboexpanded stream 111, and passed into lower pressure column 18.

In the embodiment illustrated in FIG. 1, stream 104 forms the working fluid which is used to vaporize the pressurized liquid oxygen. Stream 104 is compressed through compressor 12 to a pressure within the range of from 100 to 1200 psia and resulting pressurized working fluid stream 105 is passed into main heat exchanger or product boiler 13 wherein it is cooled by indirect heat exchange with vaporizing pressurized liquid oxygen. Preferably the pressurized working fluid is cooled to just below its saturation temperature when it is pressurized below its critical pressure and to its critical temperature when it is pressurized above its critical pressure. The working fluid is cooled so that it is condensed by the heat exchange with the vaporizing liquid oxygen when the working fluid is pressurized below its critical pressure. When the working fluid is pressurized above its critical pressure, no distinct phase change occurs. In such instances, the working fluid is preferably cooled to a temperature near its critical temperature.

The cooled pressurized working fluid is withdrawn from main heat exchanger 13 at or just prior to the cold end of this heat exchanger and passed as stream 106 to the two phase turboexpander 14 wherein it is turboexpanded to form a dual phase working fluid 107. Two phase turboexpander 14 has a flow path such that, as vapor is formed upon expansion, work is done by the further expansion of that vapor. The two phase turboexpander differs from a conventional single phase turboexpander in that the cross-sectional area for flow within the turboexpander wheel is increased at a significantly greater rate to accomodate the large increase in volumetric flow for the two phase fluid.

The vapor fraction of dual phase working fluid 107 is within the range of from 10 to 50 mole percent, preferably within the range of from 15 to 30 mole percent, and the liquid fraction of dual phase working fluid 107 is within the range of from 50 to 90 mole percent, preferably within the range of from 70 to 85 mole percent. Dual phase working fluid 107 is passed into the lower portion of higher pressure column 16. In the embodiment illustrated in FIG. 1, dual phase working fluid 107 is combined with the major portion of the feed air to form combined stream 108 which is passed into column 16.

Within higher pressure column 16 the feed air is separated by cryogenic rectification into nitrogen-enriched vapor and oxygen-enriched liquid. Nitrogen-enriched vapor is withdrawn from the upper portion of column 16 as stream 450 and condensed in main condenser 17 against boiling column 18 bottom liquid. Resulting liquid nitrogen 451 is divided into portion 452, which is passed into the upper portion of column 16 as reflux, and into portion 455, which is passed through heat exchanger 20 and into the upper portion of column 18 as reflux. If desired, a portion 454 of the liquid nitrogen may be recovered as product.

Oxygen-enriched liquid is withdrawn from the lower portion of column 16 as stream 300, and passed as stream 301 through heat exchanger 21 and into lower pressure column 18.

Within lower pressure column 18 the various feeds are separated by cryogenic rectification into gaseous nitrogen and liquid oxygen. Gaseous nitrogen is withdrawn from the upper portion of column 18 as stream 400, warmed by passage through heat exchangers 20, 21 and 13 and removed from the system as stream 402, which may be recovered, in whole or in part, as product gaseous nitrogen.

Liquid oxygen is withdrawn from the lower portion of lower pressure column 18 as stream 200. If desired, a portion of the liquid oxygen may be recovered as product in stream 201. Resulting liquid oxygen stream 202 is passed through liquid pump 19 wherein it is increased in pressure to a pressure within the range of from 20 to 1000 psia. Resulting elevated pressure liquid oxygen 203 is vaporized by passage through product boiler or main heat exchanger 13 by indirect heat exchange with the cooling pressurized working fluid. Resulting elevated pressure gaseous oxygen is recovered as product stream 204.

Figure 2:
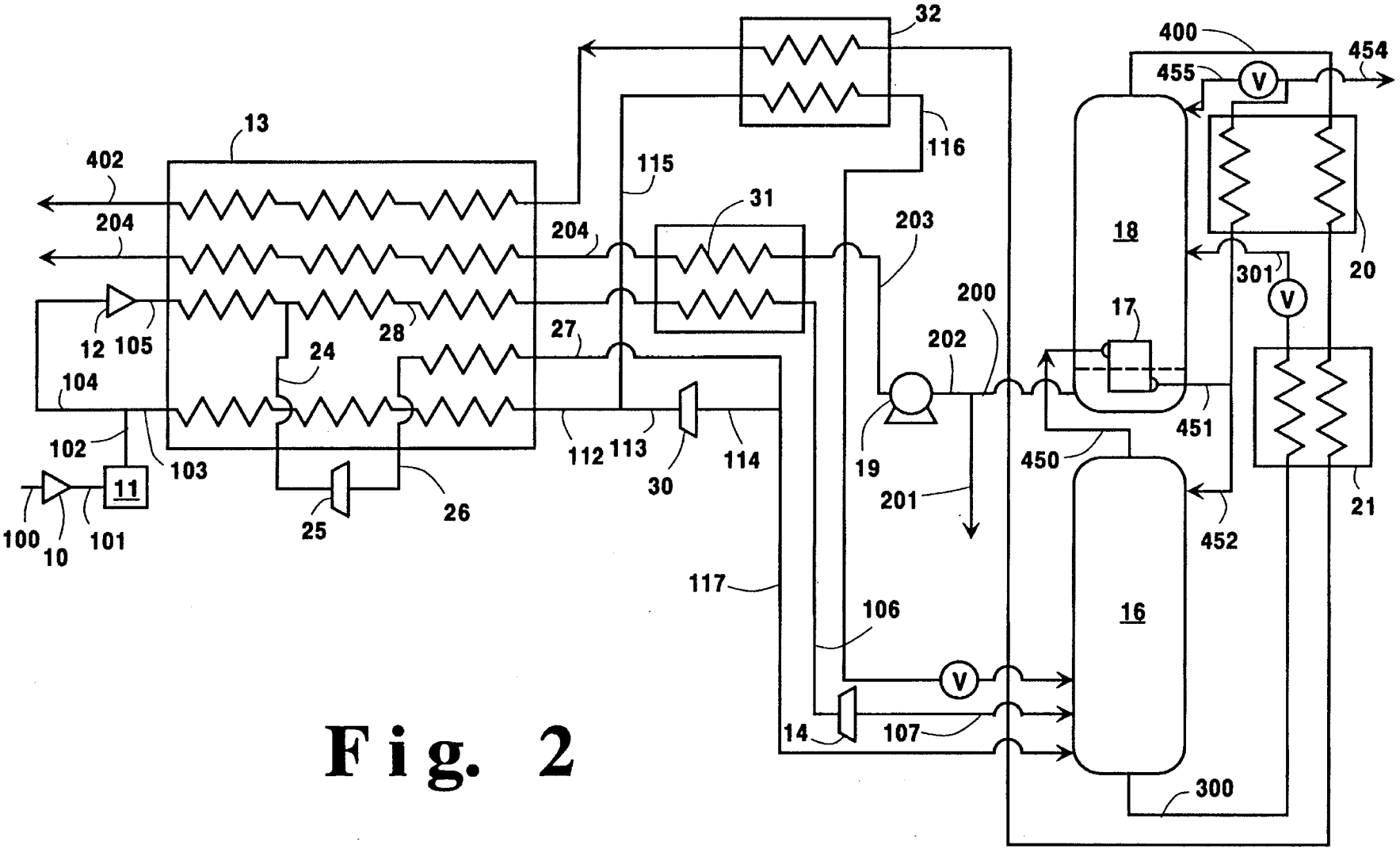
FIG. 2 is a schematic representation of another preferred embodiment of the invention which is particularly advantageous when liquid product is desired in addition to elevated pressure gaseous product.

FIG. 2 illustrates an embodiment of the invention which may be particularly attractive when large amounts of liquid oxygen and/or liquid nitrogen product is desired in addition to the elevated pressure gaseous oxygen product. The numerals of FIG. 2 correspond to those of FIG. 1 for the common elements and these common elements will not be described again in detail.

Referring now to FIG. 2, feed air stream 112 is divided into stream 115 and into stream 113. Stream 115 is cooled by passage through heat exchanger 32 by indirect heat exchange with gaseous nitrogen 400, and resulting cooled feed air stream 116 is passed into higher pressure column 16. Stream 113 is turboexpanded through turboexpander 30 to generate refrigeration and resulting stream 114 is passed into higher pressure column 16.

A portion 24 of stream 105 is withdrawn from an intermediate section of heat exchanger 13 and turboexpanded through turboexpander 25 to generate refrigeration. Resulting stream 26 is reinserted into heat exchanger 13 from where it is withdrawn as stream 27 and passed into higher pressure column 16. In the embodiment illustrated in FIG. 2 stream 27 is combined with stream 114 and the combined stream 117 passed into column 16.

The remaining portion 28 of stream 105 forms the pressurized working fluid and is cooled in heat exchanger 13 and heat exchanger 31 by indirect heat exchange with pressurized liquid oxygen 203 which undergoes vaporization in either or both heat exchangers 31 and 13. Cooled pressurized working fluid 106 is turboexpanded through turboexpander 14 to form dual phase working fluid 107 which is passed into higher pressure column 16.

Figure 3:
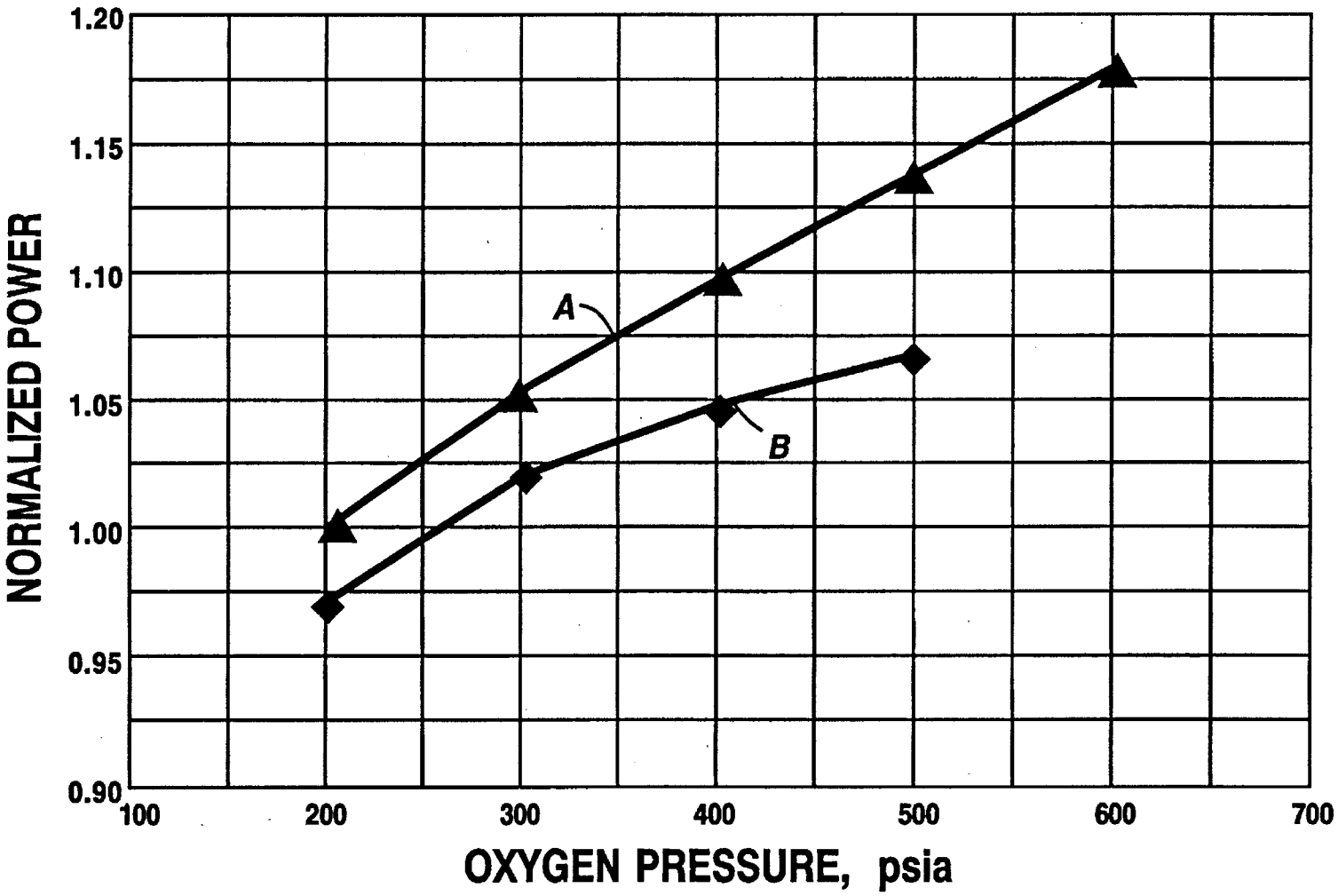
FIG. 3 is a graphical representation of the advantages of the invention compared with conventional practice employing Joule-Thompson valve expansion.

FIG. 3 graphically compares the power performance of the invention compared to that of a similar system but one which employs conventional Joule-Thompson valve expansion of pressurized working fluid. The data used to generate the curves of FIG. 3 was obtained by a computer simulation of a system similar to that illustrated in FIG. 1. In FIG. 3 curve A is the normalized power usage for gaseous oxygen production using conventional valve expansion and curve B is the normalized power usage for gaseous oxygen production using the dual phase turboexpansion of the invention. As can be seen from the data reported in FIG. 3, the invention enables the attainment of a significant power advantage over conventional practice. Moreover, this power advantage increases as the product pressure is increased.

Although the invention has been described in detail with reference to certain embodiments, those skilled in the art will recognize that there are other embodiments of the invention within the spirit and the scope of the claims. For example, the cryogenic rectification plant may include other columns such as an argon sidearm column. Moreover, the working fluid need not be a portion of the feed air. It could, for example, be a process stream taken from the cryogenic rectification plant which is returned to the plant after the dual phase turboexpansion.

We claim:

1. A method for producing elevated pressure gaseous oxygen comprising:

(A) introducing feed air into a cryogenic rectification plant and separating the feed air within the cryogenic rectification plant to produce liquid oxygen;

(B) withdrawing liquid oxygen from the cryogenic rectification plant and increasing the pressure of the withdrawn liquid oxygen to produce elevated pressure liquid oxygen;

(C) compressing a working fluid to produce pressurized working fluid and passing the pressurized working fluid in indirect heat exchange with elevated pressure liquid oxygen thereby vaporizing the elevated pressure liquid oxygen to produce elevated pressure gaseous oxygen and cooled pressurized working fluid;

(D) turboexpanding the cooled pressurized working fluid while vaporizing a portion of said working fluid to produce a dual phase working fluid having both a liquid phase and a gaseous phase; and (E) passing the dual phase working fluid into the cryogenic rectification plant.

2. The method of claim 1 wherein the working fluid is a portion of the feed air.

3. The method of claim 1 wherein the gaseous phase comprises from 10 to 75 mole percent of the dual phase working fluid.

4. The method of claim 1 wherein the cryogenic rectification plant comprises a higher pressure column and a lower pressure column and the dual phase working fluid is passed into the higher pressure column.

5. The method of claim 1 further comprising recovering some liquid oxygen as product.

6. The method of claim 1 further comprising producing liquid nitrogen in the cryogenic rectification plant and recovering some of the liquid nitrogen as product.

* * * * *